US005144938A

United States Patent [19]

Seeburger et al.

[11] Patent Number: 5,144,938

[45] Date of Patent: Sep. 8, 1992

[54] METHOD AND DEVICE FOR RESHARPENING SAWS ESPECIALLY USED FOR MAKING SEMICONDUCTOR WAFERS

[75] Inventors: Helmut Seeburger; Peter Lehfeld; Wolf-Rüdiger Kurtze, all of Burghausen, Fed. Rep. of Germany

[73] Assignee: Elektronik-Grundstoffe mbH, Burghausen, Fed. Rep. of Germany

[21] Appl. No.: 616,783

[22] Filed: Nov. 20, 1990

[30] Foreign Application Priority Data

Dec. 12, 1989 [DE] Fed. Rep. of Germany ..... 3941038

[51] Int. Cl.[5] ..... B24B 53/07

[52] U.S. Cl. ..... 125/11.12; 125/11.04; 125/13.02; 125/11.18; 51/325

[58] Field of Search ..... 51/5 D, 165.87, 325, 51/73 R; 125/11.04, 11.03, 11.01, 11.12, 11.18, 3, 13.02, 13.01, 15

[56] References Cited

U.S. PATENT DOCUMENTS

| | | | |
|---|---|---|---|
| 3,662,732 | 5/1972 | Banko et al. | 125/11.04 |
| 3,747,584 | 7/1973 | Kikuchi | 125/11.03 |
| 4,811,722 | 3/1989 | Brehm | 125/11.18 |
| 4,971,021 | 11/1990 | Kubotera et al. | 125/13.01 |
| 5,000,156 | 3/1991 | Honda et al. | 51/165.87 |

FOREIGN PATENT DOCUMENTS

| | | | |
|---|---|---|---|
| 0329087 | 2/1989 | European Pat. Off. . | |
| 59-136886 | 6/1984 | Japan . | |
| 64-221267 | 6/1989 | Japan . | |
| 1098773 | 6/1984 | U.S.S.R. | 125/11.03 |
| 0309637 | 4/1929 | United Kingdom | 51/250 |

*Primary Examiner*—Robert A. Rose
*Attorney, Agent, or Firm*—Collard & Roe

[57] ABSTRACT

A device and method for resharpening the cutting edge of saws used in particular in the centerhole sawing of semiconductor bars. It contains a sharpening system which consists of at least one elongate sharpening stone facing the cutting edge with its end face, is movable laterally relative to the saw blade and has at the end face two working surfaces which are located opposite one another and, during sharpening, can be brought into contact laterally with the cutting-edge surface facing them. The device affords trouble-free operation and permits sharpening actions during the sawing operations.

18 Claims, 1 Drawing Sheet

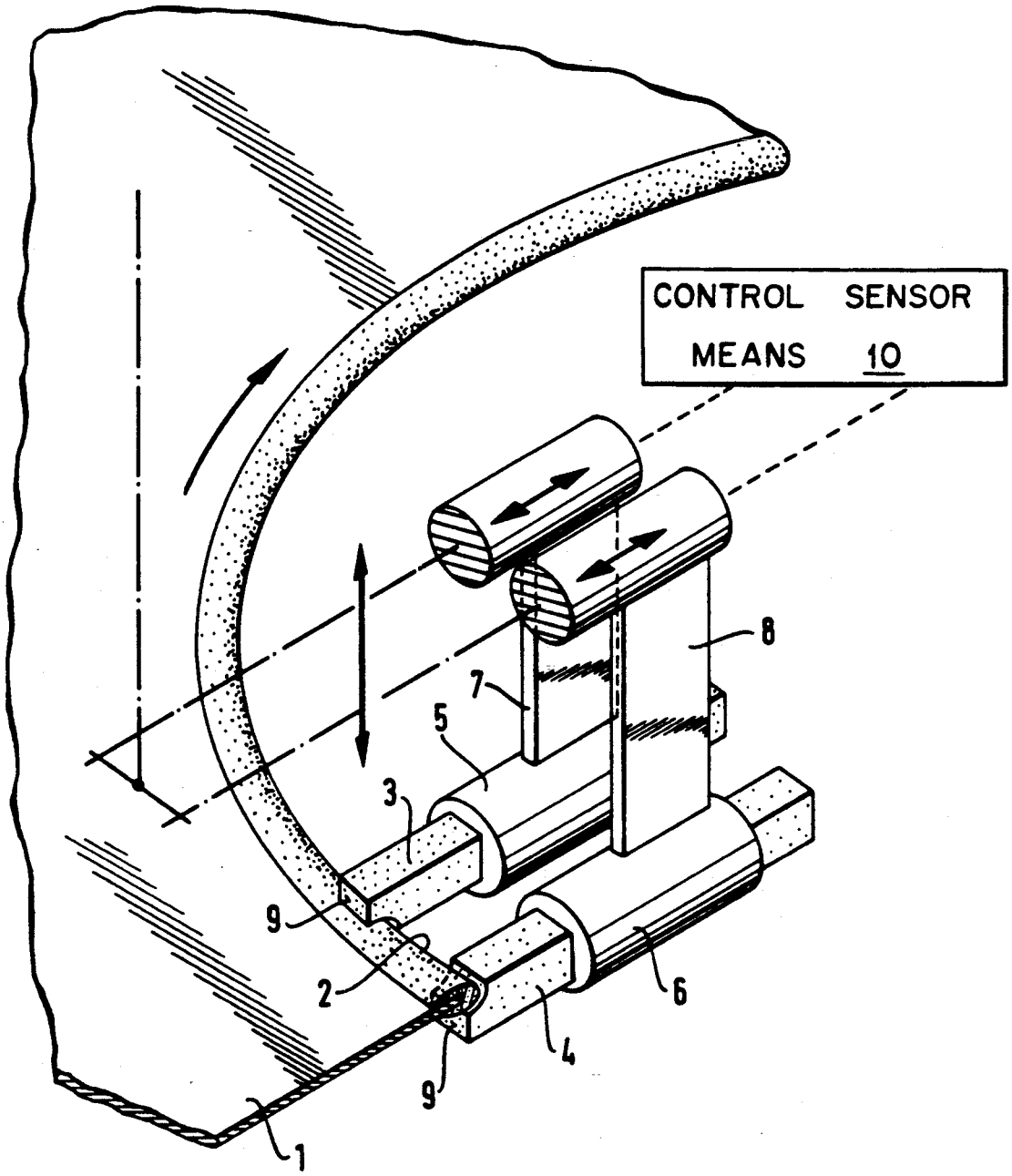
CONTROL SENSOR
MEANS 10
8
7
5
3
9
2
6
4
9
1

METHOD AND DEVICE FOR RESHARPENING SAWS ESPECIALLY USED FOR MAKING SEMICONDUCTOR WAFERS

BACKGROUND OF THE INVENTION

This invention relates to a device and method for resharpening the cutting edge of saws used for cutting wafers from bar-shaped or block-shaped workpieces, particularly semiconductor material. More specifically, it relates to such a device and process wherein the cutting edge of the saw may be resharpened while the tool is cutting.

In the centerhole sawing of bars, especially those made of semiconductor material (i.e., silicon, germanium arsenide, indium phosphide or oxidic material such as quartz, ruby, spinel or garnet, e.g., gallium gadolinium garnet), a highly geometric quality is demanded. This especially applies to silicon wafers having diameters of at least about 10 cm which are used as the basic material for the manufacture of high integrated electronic components. The constant increase in the packing density of such components is accompanied by distinctly closer tolerances with regard to the wafer geometry, which is essentially determined by the precision during the cutting operation.

The geometric quality of wafers, sawn from bars or blocks, the thickness of which is generally in the range of about 100 to 1,000 μm, can be evaluated, e.g., by a parameter known as "warp". This is the difference between the maximum and minimum distance of the center wafer surface from a reference plane. The warp of a wafer can be established according to ASTM Standard F 657-80.

It is known from EP-A-196,642 that the warp in the wafers obtained is effected by the cutting edge of the cutting tool which removes the material. In general, a centerhole saw blade or outer cutting saw blade, if resharpened during the sawing operation upon deviation from the normal progress of the art, will yield more precise cuts (i.e., it will improve the warp of the wafers). During this process, it is not the entire cutting edge which is reground but primarily the cutting-edge lateral surface which is nearer the nominal cutting line.

In this publication, a device is disclosed for performing the resharpening operation. During the sawing process, the cutting edge passes through a recess in a workhead. Inside the workhead is a band, adjustable in its inclination and covered with abrasive grains, which can be guided to the cutting edge lateral surface via a roller system, when required. However, this device is complicated and susceptible to breakdown.

SUMMARY OF THE INVENTION

It is therefore an object of the present invention to provide a simpler and more reliable sharpening device and method.

This object is achieved according to the present invention by a device which comprises a sharpening system which includes at least one elongate sharpening stone facing the cutting edge with its end face. The sharpening system is movable laterally relative to the saw blade and has at the end face two working surfaces which are located opposite one another. During sharpening, these working surfaces can be brought in contact laterally with the cutting-edge surface facing them.

This can be done, for example, by means of a sharpening system which consists of a sharpening stone and which is swung toward the side of the saw-blade requiring a sharpening action. In this way, the working surface facing the cutting edge can be brought into contact with the latter. In a further advantageous embodiment, the sharpening system consists of two sharpening stones which are arranged offset relative to one another and whose end faces are located on either side of the cutting edge. The working surfaces in each case face the cutting edge to be sharpened.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

The drawing is a schematically-illustrated perspective view of a sharpening unit according to the present invention.

DETAILED DESCRIPTION OF THE PREFERRED EMBODIMENT

Referring now in detail to the drawing, a saw blade 1 of a centerhole saw is shown clamped in a rotating clamping frame at its outer periphery (in a known manner not shown in greater detail). The inner periphery carries the cutting edge which removes material during the sawing operation. As a rule, this cutting edge, as indicated in the figure, has a drop-shaped cross-section and consists of a metal matrix, e.g., a nickel coating with cutting grains of a hard material embedded therein, for example, diamond or boron nitride. In addition to the centerhole saw shown here having a reclining, horizontal saw blade, such centerhole saws having an upright, vertical saw blade are also used, the invention being equally suitable for both arrangements.

Located above and below the saw-blade plane and offset relative to one another are the two sharpening stones 3 and 4. Both stones are directed toward the cutting edge and project slightly beyond its inner margin. In the possible embodiment shown, both sharpening stones are, as far as possible, preferably directed radially toward the cutting edge and are advantageously arranged substantially parallel to one another.

In principle, however, an exactly or approximately parallel arrangement is not necessarily specified; deviations of up to about ±10° from the exact orientation have proved to be tolerable. In lieu of such a parallel arrangement, angled arrangements are also possible (i.e., crossed arrangements or arrangements running toward one another), in which case the angles can be up to about 120°. If space restrictions exist, it can also be convenient to have the sharpening stones deviate by up to about 60° from the exactly or substantially radial orientation Furthermore, it is preferable if both sharpening stones are movable in a coupled manner, i.e., if they can be raised or lowered together. Such coupled movement can be realized with the minimum amount of equipment and thus permit, in a simple manner, effective sharpening actions on both lateral surfaces of the cutting edge. However, it is possible to provide for both sharpening stones to be movable independently of one another.

Sharpening stones which are round bars, or in particular edged bars, preferably having a square cross-section are well suited. They are conveniently dimensioned in such a way that, during sharpening, their contact distance with the cutting edge is about 3 mm to 10 mm, ideally about 4 mm to 6 mm. The length of unused sharpening stones is typically about 10 cm to 15 cm; when progressively used, they can be worn away except for the remainder necessary for attachment. Sharpening stones which, as far as possible, have similar dimensions and shape are advantageously used in order to minimize the differences between the sharpening operations on the respective cutting-edge side.

The materials commonly used in sharpening technology, for example, oilstones, are suitable for use as sharpening stones. Suitable materials are, e.g., aluminum oxide or silicon carbide which are used, e.g., in solid form or can preferably be bonded as abrasive particles into a backing material on a ceramic or plastic base. For the reasons mentioned above, both sharpening stones are, in each case, advantageously selected from the same material.

The sharpening stones are fixed in the sharpening stone fixtures 5 and 6, e.g., by clamping, locking in position, adhesive bonding or screwing. These methods ensure the accurate alignment, as free from play as possible, of the sharpening stones with regard to the cutting edge. The sharpening stone fixtures 5, 6 are connected, for example, via connecting webs 7 and 8 to a guide system (which includes a control and sensor means 10). The guide system performs lifting and lowering movements of the fixtures 5 and 6, preferably coupled to one another, and thus the sharpening stones. By the coupled raising or lowering of the sharpening stones, the working surfaces made in the end faces 9 of the sharpening stones are moved laterally up to a lateral surface of the cutting edge and alternatively brought into contact with it.

In addition to the lifting and lowering unit, a guide unit is also advantageously provided in the guide system in the radial direction so that the sharpening stones can be moved toward or away from the cutting edge. This facilitates both the replacement of the sharpening stones and resetting when the working surface of a sharpening stone is used up. The depth of engagement of the cutting edge into the end face of the sharpening stones and, therefore, the intensity of the sharpening operation can thus be controlled at the same time.

The exact guidance of the lifting and lowering movement, as well as any reciprocating movement, can be attained by suitable guide elements. This can be achieved, e.g., by properly arranged guide cylinders, guide rails or appropriate gearing. The movement can, in principle, be performed manually, by means of adjusting screws for example. It can also be performed by stepping motors, preferably computer-controlled.

The entire sharpening system is fixed to the equipment frame at a suitable position from which the sharpening stones, without hindering the sawing of wafers, can be moved into their working position in the centerhole and, when required, can be moved into contact with the cutting edge. Fixing, e.g., the sharpening system to the protective cover of the saw blade, present in most pieces of equipment, has proved successful.

During the actual sawing operation, when using the device according to the invention, the deviation of the blade relative to the nominal cutting line, while it saws through the workpiece to slice off a desired wafer, is detected in the known manner. For example, magnetic or eddy-current sensors which can track the position of the saw blade during sawing with a resolution of about 1 μm are suitable. Optionally, the cutting force and/or the impact sound can also be monitored during sawing in order to obtain further information on the progress of the cut and also on the effect of the sharpening actions.

A tolerance value is established based on the desired geometric quality of the product, i.e., the wafer, or as determined in preliminary tests. If the deflection of the saw blade during sawing exceeds that tolerance, the side of the cutting edge which faces the nominal cutting line is subjected to a sharpening action. For this purpose, the sharpening system is raised or lowered so that the working surface of the sharpening stone, which is adjacent to the lateral surface of the cutting edge to be sharpened, is brought into contact with the cutting edge.

In the process, the position of the sharpening stone can be changed step by step so that, during the sharpening action, a certain quantity of the sharpening stone is gradually removed until the cutting edge can freely rotate again. It is possible, especially during prolonged sharpening operations, to guide the sharpening stone continuously against the cutting-edge surface to be sharpened.

If the measurement shows that the deviation of the saw blade does not exceed or no longer exceeds the predetermined tolerance values, the sharpening action can be ended. The sawing operation can then be continued without sharpening until the deviation of the saw blade again makes it necessary to bring the top or bottom sharpening stone into operation. It may also be necessary to carry out additional sharpening actions outside the sawing operation with the cutting edge freely rotating.

During sharpening, the cutting edge, with its lateral surface in contact with the sharpening stone, works its way into the sharpening stone. The amount is determined by the lifting or lowering of the sharpening stones so that, ultimately, a stepped surface corresponding to the negative profile of the cutting edge shifts transversely across the end face of the sharpening stone.

The depth of engagement of the cutting edge into the sharpening stone is typically between 0.01 mm to 2 mm, preferably 0.05 mm to 0.2 mm. It is advantageously set in such a way that the cutting edge, at least from its apex surface up to its maximum cross-section, can come into contact with the sharpening stone. This depth of engagement can be set, e.g., by means of the guide elements permitting a radial displacement of the sharpening stones. The radial infeed distance necessary for a certain sharpening effect can be estimated, for example, through measurements of the cutting force.

When the sharpening stones are still unused or the end faces have not yet been stressed, it is desirable, before the actual sawing operation, to briefly bring the sharpening stones into contact with the lateral surfaces of the cutting edge. Contact is effected at a depth of engagement selected in order to produce a correspondingly shaped working surface on the end face of the sharpening stone.

The invention can be advantageously used with centerhole saws and is suitable, in particular, for those processes in which the sharpening action takes place during the actual sawing of the bar or block into wafers. This is a distinct advantage over the processes in which the sharpening actions only take place when the saw blade is freely rotating, as a result of which, the success or failure of the operation can only be checked with reference to the subsequently cut wafer. Unusable scrap wafers inevitably result from this method.

The invention has proved successful in the centerhole sawing of workpieces requiring a large depth of engagement of the saw blade, and, in particular, the centerhole sawing of wafers from single-crystalline bars of, e.g., silicon, having large diameters (i.e., at least about 100 mm and, in particular, from about 150 mm). The device is also useful for outer edge saws whose cutting edge lies at the outer periphery of the saw blade.

The invention is explained in more detail below with reference to an exemplary embodiment.

A commercially available arrangement for the centerhole sawing of silicon bars includes a centerhole saw with an outside diameter of about 86 cm and a centerhole diameter about 30.5 cm, the cutting edge thereof being nickel-coated with embedded diamond grains. The sharpening device, configured in an analogous manner to the figure was fitted to the protective cover of the centerhole saw unit. The sharpening system was lifted and lowered manually by means of an adjusting screw via a guide cylinder. The sharpening system is oriented axially relative to the saw blade plane. The two sharpening stone fixtures were fed into the centerhole of the horizontal saw blade via the two connecting webs.

Clamped into each fixture, by means of screws, was an approximately 10 cm long sharpening stone. The stone had a square cross-section, the edge length measuring about 6 mm. It consisted of a ceramic mass having embedded abrasive corundum grains. The stones were oriented substantially parallel to one another. They were pointed substantially radially toward the cutting edge of the saw blade. In the initial position, they were offset by about 60 mm relative to one another. Their end sections, provided as working surfaces, were located above and below the cutting edge, respectively.

First, by briefly raising or lowering the lifting unit, the top and bottom sharpening stones were brought into contact with the freely rotating edge. The depth of engagement for both sharpening stones was about 0.2 mm. The device was thus ready for operation.

The actual sawing operation could now be started in which a silicon bar (diameter about 150 mm) was sawn successively into wafers of about 0.8 mm thickness. During each sawing operation, the movement of the saw blade through the workpiece was monitored by eddy-current sensors. A deviation from the nominal progress of the cut of about $\pm 10$ $\mu$m was the determined tolerance. If this value was exceeded, the cutting-edge lateral surface facing the nominal cutting line was in each case brought into contact with the corresponding working surface of a sharpening stone. This was accomplished by lifting or lowering the sharpening device while the sawing operation continued unchanged. In this process, contact was maintained (optionally by continuous resetting) until the measuring sensor indicated that the saw blade began to move back toward the nominal cutting line.

By this method, about 1,000 silicon wafers were produced by this sawing technique. The warp value, according to ASTM Standard F 657-80, was used as a criterion for the geometric quality of the wafers. Of all the wafers, 97.5% adhered to or fell short of the warp value. The value was around 20 $\mu$m. In sawing operations without sharpening actions of this type, warp values only around 30 $\mu$m could be achieved.

Accordingly, while only one embodiment of the present invention have been shown and described, it is obvious that many changes and modifications may be made thereunto without departing from the spirit and scope of the invention.

What is claimed is:

1. A device for resharpening the cutting edge of a saw blade used in the sawing of wafers from bar-shaped or block-shaped semiconductor workpieces comprising:

sharpening means, movable laterally with respect to the saw blade between an operative and inoperative position, including two elongate sharpening stones, each stone having an end face facing the cutting edge of the saw blade, each said end face having a working surface complementary to a portion of a desired shape of said cutting edge and in overlapping relation such that, during sharpening, said stones can be brought into contact laterally with the cutting edge of the saw blade facing them;

means for moving said sharpening means between said inoperative and operative position, in the latter of which said sharpening means is positioned to sharpen said saw blade without interrupting the sawing of said wafers; and said sharpening means being applied in a non-rotational manner to said cutting edge to thereby dress the entire edge of the saw blade.

2. The device according to claim 1, wherein said device additionally includes means for moving said sharpening means laterally relative to the saw blade.

3. The device according to claim 1, wherein the sharpening means is oriented radially toward the cutting edge.

4. The device according to claim 1, wherein the saw is a centerhole saw.

5. The device according to claim 1, wherein the sharpening means comprises two sharpening stones, which are arranged offset relative to one another and having end faces, each of which has a working surface located on opposite sides of the cutting edge, the working surface in each case facing the cutting edge.

6. The device according to claim 5, wherein the two stones are coupled and are movable in a coupled manner.

7. The device according to claim 5, wherein the two stones are arranged substantially in parallel.

8. The device according to claim 5, wherein the sharpening stones are oriented radially toward the cutting edge.

9. The device according to claim 5, wherein the saw is a centerhole saw.

10. A method of centerhole sawing bar-shaped or block-shaped workpieces which comprises:

sawing said workpieces with a rotating centerhole saw;

sharpening the rotating saw blade during sawing via sharpening means, movable laterally with respect to the saw blade and including two elongate sharpening stones, each stone having an end face facing the cutting edge of the saw blade, each said end face having a working surface complementary to a portion of a desired shape of said cutting edge and in overlapping relation, such that, during sharpening, said stones are brought into contact laterally with the cutting edge of the saw blade facing them; and applying said sharpening means in a non-rotational manner to said cutting edge to thereby dress the entire cutting edge of the saw blade.

11. The method according to claim 10, wherein the workpieces to be cut are semiconductor workpieces.

12. The method according to claim 10, wherein the sharpening is carried out on the cutting-edge lateral surface facing a nominal cutting line.

13. The device according to claim 5, wherein said two sharpening stones have a contact surface with the cutting edge, the contact surface having a length in the range of 3–10 mm.

14. The device according to claim 13, wherein said two sharpening stones have a contact surface with the cutting edge, the contact surface having a length in the range of 4–6 mm.

15. A device for resharpening the cutting edge of a saw blade used in the sawing of wafers from bar-shaped or block-shaped semiconductor workpieces comprising:

sharpening means, movable laterally with respect to the saw blade between an operative and inoperative position, including two elongate sharpening stones, each stone having an end face facing the cutting edge of the saw blade, each said end face having a working surface complementary to a portion of a desired shape of said cutting edge and in overlapping relation, such that, during sharpening, said stones can be brought into contact laterally with the cutting edge of the saw blade facing them;

means for moving said sharpening means between said inoperative and operative position, in the latter of which said sharpening means is positioned to sharpen said saw blade without interrupting the sawing of said wafers;

control and sensor means for monitoring the deviation of the saw blade relative to a nominal cutting line while it saws through the workpiece to slice off a desired wafer, and effecting movement of said means for moving; and said sharpening means being applied in a non-rotational manner to the cutting edge to thereby dress the entire cutting edge of the saw blade.

16. A device for resharpening the cutting edge of a saw blade used in the sawing of wafers from bar-shaped or block-shaped semiconductor workpieces comprising:

sharpening means, movable laterally with respect to the saw blade between an operative and inoperative position, including at least one elongate sharpening stone having an end face facing the cutting edge of the saw blade, said end face having two working surfaces disposed opposite to one another which, during sharpening, can be brought into contact laterally with the cutting edge of the saw blade facing them, said surfaces complementary to a portion of a desired shape of said cutting edge and in overlapping relation;

means for moving said sharpening means between said inoperative and operative position, in the latter of which said sharpening means is positioned to sharpen said saw blade without interrupting the sawing of said wafers; and said sharpening means being applied in a non-rotational manner to said cutting edge to thereby dress the entire edge of the saw blade.

17. A method of centerhole sawing bar-shaped or block-shaped workpieces which comprises:

sawing said workpieces with a rotating centerhole saw;

sharpening the rotating saw blade during sawing via sharpening means, movable laterally with respect to the saw blade and including at least one elongate sharpening stone having an end face facing the cutting edge of the saw blade, said end face having two working surfaces disposed opposite to one another which, during sharpening, is brought into contact laterally with the cutting edge of the saw blade facing them, said surfaces complementary to a portion of a desired shape of said cutting edge and in overlapping relation; and applying said sharpening means in a non-rotational manner to said cutting edge to thereby dress the entire cutting edge of the saw blade.

18. A device for resharpening the cutting edge of a saw blade used in the sawing of wafers from bar-shaped or block-shaped semiconductor workpieces comprising:

sharpening means, movable laterally with respect to the saw blade between an operative and inoperative position, including at least one elongate sharpening stone having an end face facing the cutting edge of the saw blade, said end face having two working surfaces disposed opposite to one another which, during sharpening, can be brought into contact laterally with the cutting edge of the saw blade facing them, and said surfaces complementary to a portion of a desired shape of said cutting edge and in overlapping relation;

mean for moving said sharpening means between said inoperative and operative position, in the latter of which said sharpening means is positioned to sharpen said saw blade without interrupting the sawing of said wafers;

control and sensor means for monitoring the deviation of the saw blade relative to a nominal cutting line while it saws through the workpiece to slice off a desired wafer, and effecting movement of said means for moving; and said sharpening means being applied in a non-rotational manner to the cutting edge to thereby dress the entire cutting edge of the saw blade.

* * * * *

UNITED STATES PATENT AND TRADEMARK OFFICE

CERTIFICATE OF CORRECTION

PATENT NO. : 5,144,938

DATED : September 8, 1992

INVENTOR(S) : Helmut Seeberger et al

It is certified that error appears in the above-identified patent and that said Letters Patent is hereby corrected as shown below:

Title page, item 73, following "Assignee:" delete "Elektronik-Grundstoffe mbH" and insert the complete, correct name of the assignee as follows: --Wacker-Chemitronic Gesellschaft fur Elektronik-Grundstoffe mbH--.

Signed and Sealed this

Seventeenth Day of August, 1993

Bruce Lehman

*Attest:*

BRUCE LEHMAN

*Attesting Officer*

*Commissioner of Patents and Trademarks*